US006560932B2

(12) United States Patent
Heroux

(10) Patent No.: US 6,560,932 B2
(45) Date of Patent: May 13, 2003

(54) REMOVABLE DRAFT EXCLUDER HAVING A FOLDABLE CLOSING END

(76) Inventor: Steve Heroux, 29 White Face, South Burlington, VT (US) 05403

( * ) Notice: Subject to any disclaimer, the term of this patent is extended or adjusted under 35 U.S.C. 154(b) by 0 days.

(21) Appl. No.: 09/886,015

(22) Filed: Jun. 22, 2001

(65) Prior Publication Data

US 2002/0062597 A1 May 30, 2002

Related U.S. Application Data

(63) Continuation-in-part of application No. 09/725,306, filed on Nov. 29, 2000, now abandoned.

(51) Int. Cl.[7] ..... E06B 1/70
(52) U.S. Cl. ..... 49/469; 49/467; 49/475.1
(58) Field of Search ..... 49/70, 467, 469, 49/470, 475.1, 477.1, 495.1

(56) References Cited

U.S. PATENT DOCUMENTS

| | | | | |
|---|---|---|---|---|
| 2,592,861 | A | | 4/1952 | Close |
| 3,555,734 | A | | 1/1971 | Hirtle et al. |
| 3,690,037 | A | | 9/1972 | Kempel |
| 3,854,246 | A | | 12/1974 | McAllister |
| 3,968,597 | A | | 7/1976 | Hirtle |
| 4,006,562 | A | | 2/1977 | Belanger et al. |
| 4,034,511 | A | | 7/1977 | Bursk |
| 4,114,319 | A | | 9/1978 | Governale |
| 4,765,094 | A | | 8/1988 | Gemmell |
| 5,056,263 | A | | 10/1991 | Bies |
| 5,174,065 | A | | 12/1992 | Schlicht |
| 5,475,948 | A | | 12/1995 | Parke |
| 6,068,009 | A | * | 5/2000 | Paes et al. ..... 135/117 |

FOREIGN PATENT DOCUMENTS

| | | | |
|---|---|---|---|
| FR | 2675532 | A | 10/1992 |
| GB | 445487 | A | 4/1936 |
| GB | 875480 | A | 8/1961 |
| GB | 1079667 | A | 8/1967 |
| GB | 2184153 | A | 6/1987 |
| GB | 2238069 | A | 5/1991 |
| GB | 2255121 | A | 10/1992 |

* cited by examiner

*Primary Examiner*—Gregory J. Strimbu
(74) *Attorney, Agent, or Firm*—Holland & Knight LLP

(57) ABSTRACT

A removable draft excluder for excluding drafts by sealing a gap between a bottom surface of a door and an underlying floor surface includes a first and a second sleeve, each having a generally elongated configuration for respectively receiving a first and a second blocking member, and a base section extending between the sleeves and maintaining the latter in a generally parallel and spaced apart relationship relative to each other. At least one of the sleeves defines longitudinally opposed sleeve first and second ends. One of the ends of the at least one sleeve is open and foldable about a fold line towards the other end of the at least one sleeve, which is closed, into a folded configuration so as to retain a respective one of the blocking members inside the sleeve between the sleeve ends. A fastening device releasably maintains the sleeve foldable end in the folded configuration.

20 Claims, 3 Drawing Sheets

REMOVABLE DRAFT EXCLUDER HAVING A FOLDABLE CLOSING END

CROSS-REFERENCE TO RELATED APPLICATION

This application is a Continuation-in-part (C.I.P.) of patent application Ser. No. 09/725,306, filed on Nov. 29, 2000 now abandoned.

FIELD OF THE INVENTION

The present invention relates to a seal device and, more particularly, to a removable draft exclude device for protecting against cold drafts or the like by creating a seal to close the gap between a door and its underlying floor.

BACKGROUND OF THE INVENTION

The need to create a thermal barrier at the base portion of doorway is a continuing pursuit in the construction industry. Various patents have been issued for devices that are directly attached to the door or the threshold base and act to inhibit the flow of cold or warm air, moisture or dust into the open space of the room.

The early 1900 saw the evolution of a number of devices that essentially acted as rain guards. These were generally metallic in nature and required the installation of the device on the door, frame or both. U.S. Pat. No. 16,341 granted to Smith on Jan. 6, 1857, U.S. Pat. No. 641,139 granted to Ogan on Jan. 9, 1900, U.S. Pat. No. 924,434 granted to Cox on Jun. 8, 1909, U.S. Pat. No. 2,202,482 granted to Dahl on May 8, 1940, U.S. Pat. No. 2,565,393 granted to Oswald on Aug. 21, 1951 and U.S. Pat. No. 2,786,244 granted to Rapin on Mar. 26, 1957 all show the evolution of the weather strip from its most basic form to the more sophisticated versions. More recently, the mechanisms disclosed in the patents became more sophisticated.

U.S. Pat. No. 5,001,865 issued on Mar. 26, 1991 to Procton shows a molded threshold seal with a compressible member which must be installed into a stationary threshold base to create a weather seal. U.S. Pat. No. 5,083,400 granted Jan. 28, 1992 to Bowman discloses a device that uses a cylindrical tube that fits into a slot cut into the base of the door. The cylindrical tube is self-leveling and regulated by pistons.

U.S. Pat. No. 5,469,665 granted on Nov. 28, 1995 to Biebuyck discloses the creation of a seal by bringing together two interlocking plate and their associated flaps. One of the plates has to be permanently attached to the doorframe while the other is attached to the threshold frame.

All of the above mentioned inventions require permanent installation, which entails drilling of the door, base portion or both. There is then a high cost associated with the installation procedure. Past inventions must be up kept and adjusted by a professional at regular intervals. Furthermore there is an added expense in the replacement of the unit as it wears down and all of the above-mentioned devices are not generally intended for doors other than those facing the outside.

Other prior art documents such as U.S. Pat. Nos. 4,765,094 to Gemmell and 5,475,948 to Parke and published patent applications 1,079,667 to Stow, 2,238,069 to Paget and 2,255,121 to Smith et al. of the United Kingdom disclose draught excluders without any length adjustable blocking members for adapting to the width of the door and/or elongated sleeve members, receiving the blocking members, adapted to partially fold under the door for enhanced sealing effect of the excluder.

OBJECTS OF THE INVENTION

It is therefore a general object of the present invention to provide a removable draft excluder device that obviates the above noted disadvantages.

Another object of the present invention is to provide a removable draft excluder device that can easily be installed.

A further object of the present invention is to provide a removable draft excluder device that can easily be removed for convenience of the consumer on per need basic and reinstalled at any other location.

Still another object of the present invention is to provide a removable draft excluder device that is manufactured at a minimum cost.

Still a further object of the present invention is to provide a removable draft excluder device that can simultaneously guard air gaps between a door and its respective floor from both sides of the door.

Yet another object of the present invention is to provide a removable draft excluder device that can be adjusted to the width of the door.

Yet a further object of the present invention is to provide a removable draft excluder device that have deformable sleeve members partially entering into the gap under the bottom of the door to improve the seal thereat.

Other objects and advantages of the present invention will become apparent from a careful reading of the detailed description provided herein, with appropriate reference to the accompanying drawings.

SUMMARY OF THE INVENTION

According to one aspect of the present invention, there is provided a removable draft excluder for excluding draft by sealing a gap between a bottom surface of a door and an underlying floor surface, the door bottom surface defining a bottom surface length and two generally opposed bottom surface longitudinal edges, the latter defining a bottom surface width therebetween, the draft excluder comprises:

a first and a second sleeve, each having a generally elongated configuration for respectively receiving a first and a second blocking member;

a base section extending between the first and second sleeves and maintaining the latter in a generally parallel and spaced apart relationship relative to each other;

the first sleeve defining a sleeve first end, a longitudinally opposed sleeve second end and a sleeve length therebetween, the sleeve first end being closed and the sleeve second end being open; the first blocking member defining a blocking member first end, a blocking member second end and a blocking member length therebetween; the blocking member length being smaller than the sleeve length so that when the first blocking member is inserted into the first sleeve with the blocking member first end positioned adjacent the sleeve first end the first sleeve defines a sleeve foldable segment extending between a fold line positioned generally in register with the blocking member second end and the sleeve second end, the foldable segment being foldable about the fold line towards the sleeve first end into a folded configuration, the length of the foldable segment being generally proportional to the difference between the sleeve length and the blocking member length;

wherein when the first sleeve is in an unfolded configuration with the sleeve foldable segment extending generally collinearly from the remainder of the sleeve, the sleeve foldable segment allows the insertion and withdrawal of the first blocking member into and from the first sleeve; and wherein when the foldable segment is in the folded configuration an abutting section of the first sleeve positioned adjacent the fold line abuttingly contacts the blocking member second end for preventing axial movement of the first blocking member relative to the first sleeve; and fastening means for releasably maintaining the foldable segment in the folded configuration;

whereby the draft excluder sealing the gap with the base section being in a generally underlying and an overlying relationship relative to the door bottom surface and the floor surface, respectively; and with each of the first and second sleeves, with a respective one of the first and second blocking members inserted therein, generally extending adjacent a respective one of the bottom surface longitudinal edges to simultaneously substantially abut the respective one of the bottom surface longitudinal edges and the floor surface.

Preferably, the fastening means is a hook and loop fastener.

Preferably, the blocking member length is substantially equal to the door bottom surface length.

Preferably, the base section extends integrally from both the first and second sleeves.

Preferably, the fastening means is secured to the base section adjacent the sleeve second end.

Preferably, the first and second sleeves are made out of a fabric material that is water impermeable.

Typically, the base section is stretchable in a direction transverse to the first and second sleeves so as to enable both of the first and second sleeves, with corresponding of the first and second blocking members inserted therein, to be simultaneously in abutment contact with corresponding of the bottom surface longitudinal edges.

Preferably, the first and second sleeves are spaced away from each other by a distance substantially equal to the bottom surface width.

Preferably, both first and second sleeves include a foldable segment.

According to a second aspect of the present invention, there is provided a removable draft excluder for excluding draft by sealing a gap between a bottom surface of a door and an underlying floor surface, the door bottom surface defining two generally opposed bottom surface longitudinal edges, the draft excluder comprises:

a first and a second sleeve, each having a generally elongated configuration for respectively receiving a first and a second blocking member;

a base section extending between the first and second sleeves and maintaining the latter in a generally parallel and spaced apart relationship relative to each other;

each one of the sleeves defining a sleeve first end, a longitudinally opposed sleeve second end and a sleeve length therebetween, the sleeve first end being closed and the sleeve second end being open; each one of the blocking members defining a blocking member first end, a blocking member second end and a blocking member length therebetween; the blocking member length being smaller than the sleeve length so that when the blocking member is inserted into the sleeve with the blocking member first end positioned adjacent the sleeve first end the sleeve defines a sleeve foldable segment extending between a fold line positioned generally in register with the blocking member second end and the sleeve second end, the foldable segment being foldable about the fold line towards the sleeve first end into a folded configuration, the length of the foldable segment being generally proportional to the difference between the sleeve length and the blocking member length;

wherein when the sleeve is in an unfolded configuration with the sleeve foldable segment extending generally collinearly from the remainder of the sleeve, the sleeve foldable segment allows the insertion and withdrawal of the blocking member into and from the sleeve; and wherein when the foldable segment is in the folded configuration an abutting section of the sleeve positioned adjacent the fold line abuttingly contacts the blocking member second end for preventing axial movement of the blocking member relative to the sleeve; and fastening means for releasably maintaining the foldable segment in the folded configuration;

whereby the draft excluder sealing the gap with the base section being in a generally underlying and an overlying relationship relative to the door bottom surface and the floor surface, respectively; and with each of the first and second sleeves, with a respective one of the first and second blocking members inserted therein, generally extending adjacent a respective one of the bottom surface longitudinal edges to simultaneously substantially abut the respective one of the bottom surface longitudinal edges and the floor surface.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings preferred embodiments of the present invention will be herein described for indicative purposes and by no means as of limitation.

Figure 1:
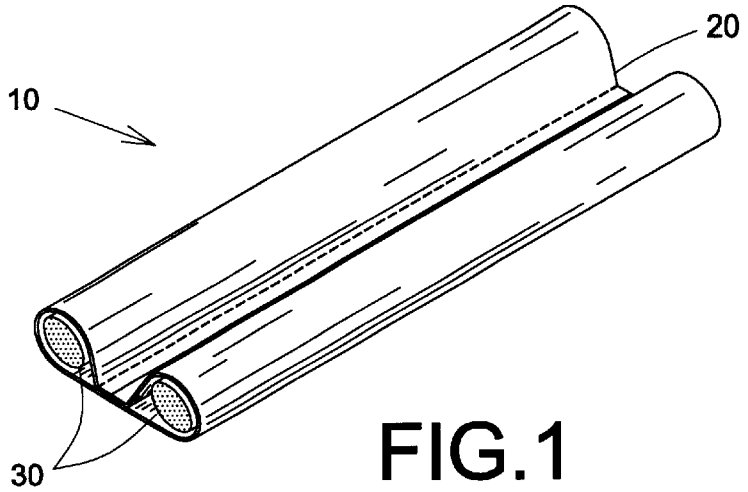
FIG. 1 is a perspective view of an embodiment of a removable draft excluder device according to the present invention.
Figure 2:
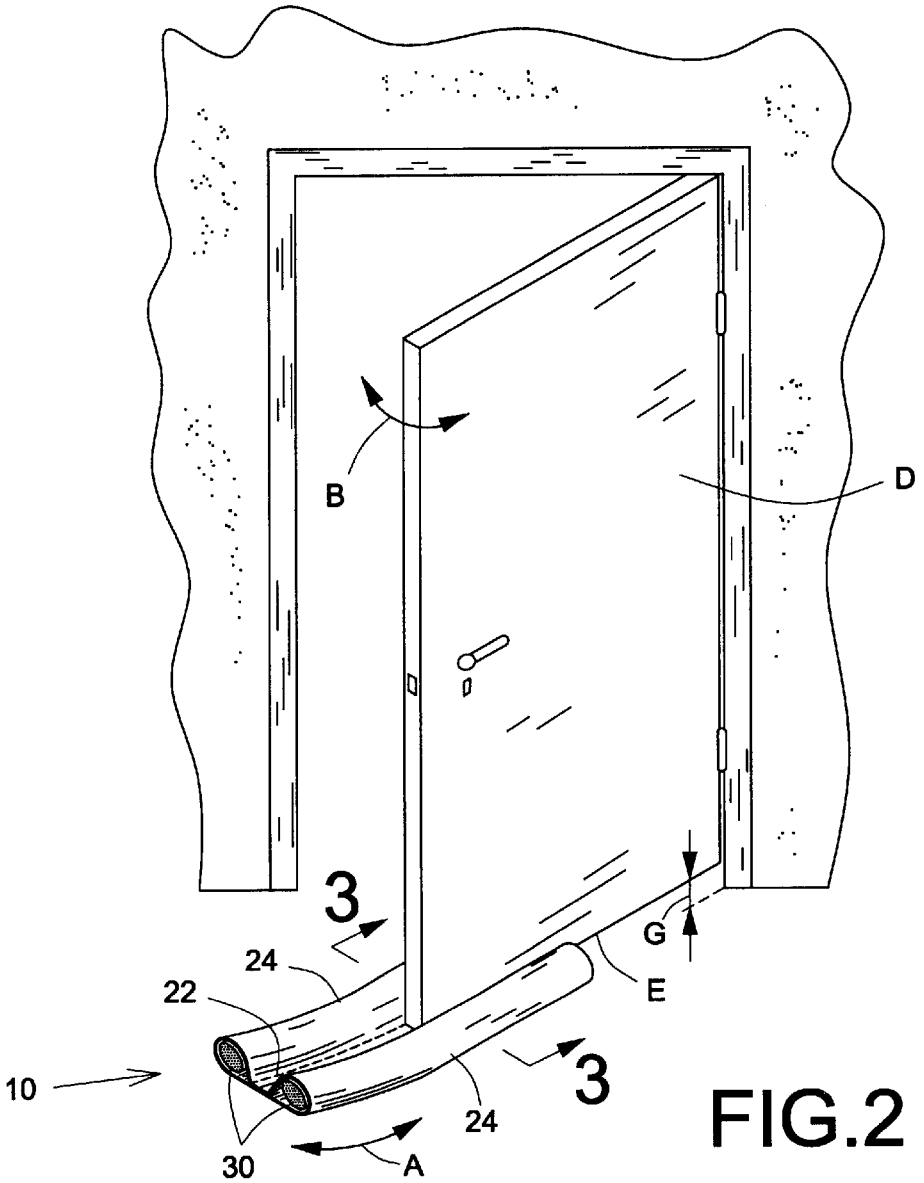
FIG. 2 is a perspective view showing the embodiment FIG. 1 being installed on under the bottom surface of a door.
Figure 3:
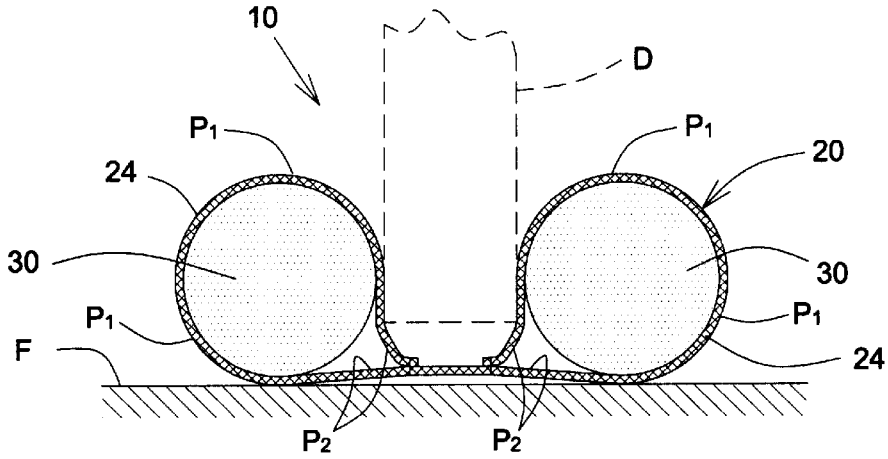
FIG. 3 is a section view taken along line 3—3 of FIG. 2.

Referring to FIGS. 1 to 3 there is shown a first embodiment 10 of a removable draft excluder device according to the present invention which is adapted for substantially closed at least one side of an elongated gap G between a bottom surface E of a door D and a floor F therebeneath without being secured to the door D. The device 10 is sizable to fit different door D widths as draft guard and follows the door D along arrow B by sliding over the underlying floor F when the door D pivots around its mounting hinges (see FIG. 2).

The device 10 includes an elongated flexible body 20 used for substantially wrapping around the bottom surface E of the door D. The body 20 has a base section 22 that longitudinally extends through the gap G and joins two generally elongated sleeve members 24 integrally and laterally protruding from the base member 22 on opposite sides of the gap G adjacent opposite edges of the bottom surface E in a generally parallel and spaced apart relationship relative to each other. The body 20 also includes two blocking members 30, each one slides to substantially fully engage (as shown by arrow C in FIG. 4) a respective sleeve member 24 and has a length and a cross-section perimeter that allow to generally continuously close off the gap G along respective edge of the door bottom surface E all along its length.

The cross-section perimeter of each blocking member 30 is substantially smaller than the cross-section perimeter of its respective sleeve member 24 such that it adjustably and loosely fits therein. When the device 10 is inserted through the gap G as shown in FIG. 2, a first portion P1 of the cross-section perimeter of at least one of the sleeve members 24 substantially freely assumes part of the cross-section perimeter of the blocking member 30 outside of the gap G and a second portion P2 of the same 24 extends into the gap G and closes off the same when the blocking member 30 is kept tight against the door bottom surface E and the floor F as illustrated in FIG. 3.

The sleeve members 24 are formed via stitches or the like on the material of the body 20, as represented by dashed lines in FIGS. 1, 2, 4 and 5*a* to 7. Alternatively, each sleeve member 24 could be openable and closable using a Velcro™ tape or the like (not shown) instead of stitches.

Preferably, the blocking members 30 and the body 20 are of a length approximately equal to the width of the door D or the length of the door bottom surface E.

Figure 4:
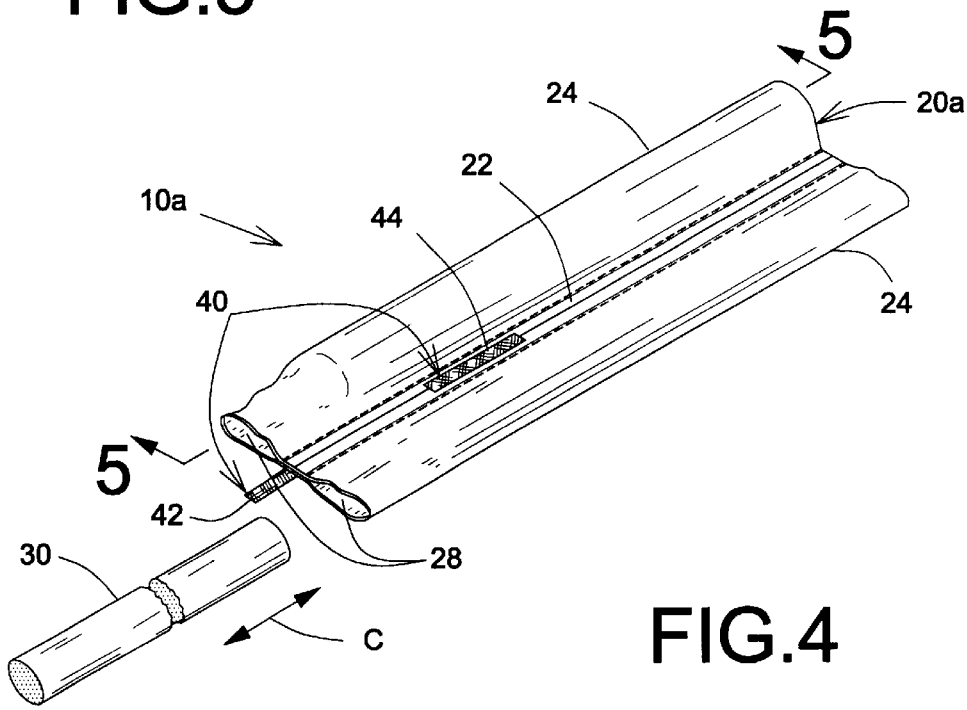
FIG. 4 is a view similar to FIG. 1, showing a second embodiment of a removable draft excluder device according to the present invention with one of the blocking members to be housed into a sleeve member of the flexible body.
Figure 5:
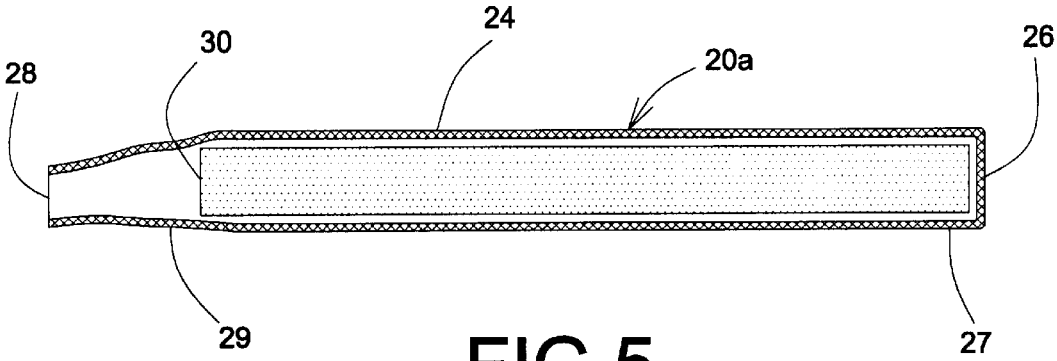
FIG. 5 is a sectional view taken along line 5—5 of FIG. 4.

Referring to FIGS. 4 and 5, there is shown a second embodiment 10*a* of a removable draft excluder device according to the present invention in which each blocking member 30 fully engages its respective sleeve member 24. The latter has a closing 26 on a first end 27 of the body 20*a* and a free opening 28 on a second end 29, or foldable segment or retaining section, of the same 20*a* for receiving each blocking member 30 there through.

Figure 5A:
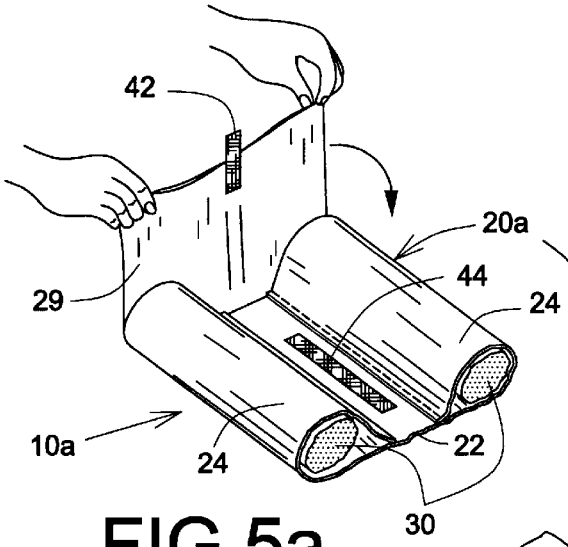
FIGS. 5*a* and 5*b* are perspective section views, showing a folding procedure of the embodiment of FIG. 4.
Figure 5B:
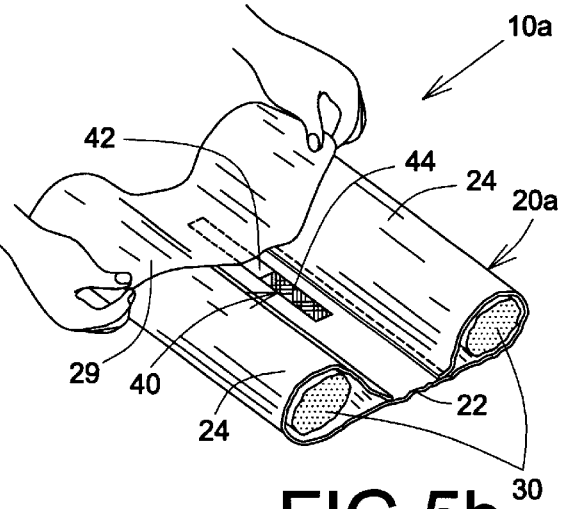

Accordingly, the body 20*a* is of a length slightly longer than the length of the blocking members 30 to enable to fold the second end 29 along a fold line located between the two ends 27, 29 towards the first end 27 for closing off the free opening 28 and to releasably secure or retain the blocking member 30 inserted therein against any axial displacement relative thereto (see FIGS. 5*a* and 5*b*). This folding essentially reduces the length of the body 20*a* down to the length of the blocking members 30 and the width of the door D.

As shown in FIGS. 4, 5*a* and 5*b*, the body 20*a* has at least one fastening member 40 preferably in the form of a hook 42 and loop 44 fastener, commonly known as Velcro™ tape. Preferably, the hook part 42 is secured to a longitudinal end of the base section 22 adjacent the second end 29 of the body 20*a* while the loop part 44 is secured along the base 22 of the body 20*a* for adjustably secure that hook part 42 thereto when the second end 29 is in the sleeve folded configuration (see FIG. 5*b*).

The body 20*a* can be made out of different fabric materials that could be either water impermeable and/or thermally insulating. The material could also be stretchable, especially in a direction from one sleeve member 24 to the other so as to have the bottom surface E of the door D clamped (or sandwiched) between the two blocking members 30, as shown in FIG. 3. Preferably, the material is a plastic type material to ensure a relatively good sliding of the device 10, 10*a* over the floor F.

Preferably, the distance between the two sleeve members 24 is substantially equal to or slightly smaller than the thickness of the door D or width of the door bottom surface E.

Figure 7:
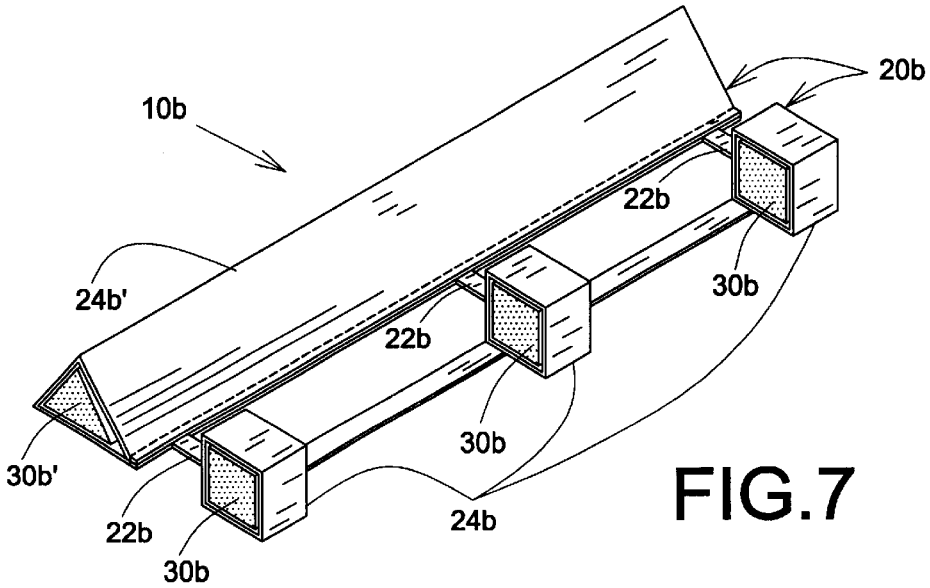
FIG. 7 is a view similar to FIG. 1, showing a third embodiment of a removable draft excluder device according to the present invention with different base section of the body and blocking members.

The blocking members 30 have an elliptical, preferably circular, cross-section shape (see FIG. 3) or any different polygonal cross-section shapes, as illustrated on a third embodiment 10*b* of a removable draft excluder device according to the present invention of FIG. 7 with preferably foam type insulators 30*b*, 30*b*' and respective sleeve members 24*b*, 24*b*'. Additionally, as shown in FIG. 7, one of the insulator 30*b* could have a plurality of sections spread along the door bottom surface E and be covered by a corresponding sleeve member 24*b*. Furthermore, the base section 22*b* of the main body 20*b* of the third embodiment 10*b* could have a plurality of base subsections substantially parallel and adjacent to each other along the door bottom surface E. Obviously, it is also possible that insulators 30*b*, 30*b*' have different shapes from each other.

Obviously, the blocking members 30 could alternatively be inflatable (not shown), telescopic for length adjustment (not shown), or even have a longitudinally variable cross-section shape.

The device 10, 10*a*, 10*b* of the present invention is adaptable to the width of the door D and can be easily removed from the bottom surface E of a door and be reinstalled under another door D.

The length of the blocking members 30 is adjusted or cut according to the width dimension of the door D by using ordinary scissors or the like. Once properly cut, the blocking members 30, ready for installation, are inserted into each sleeve member 24 (see FIGS. 1, 4, 5 and 7). Now the installer only needs to fold the second end 29 of the sleeve 34 of main body 20 towards the first end 27 (see FIG. 5*a*) and to secure the fastening member 40 (see FIG. 5*b*).

Figure 6:
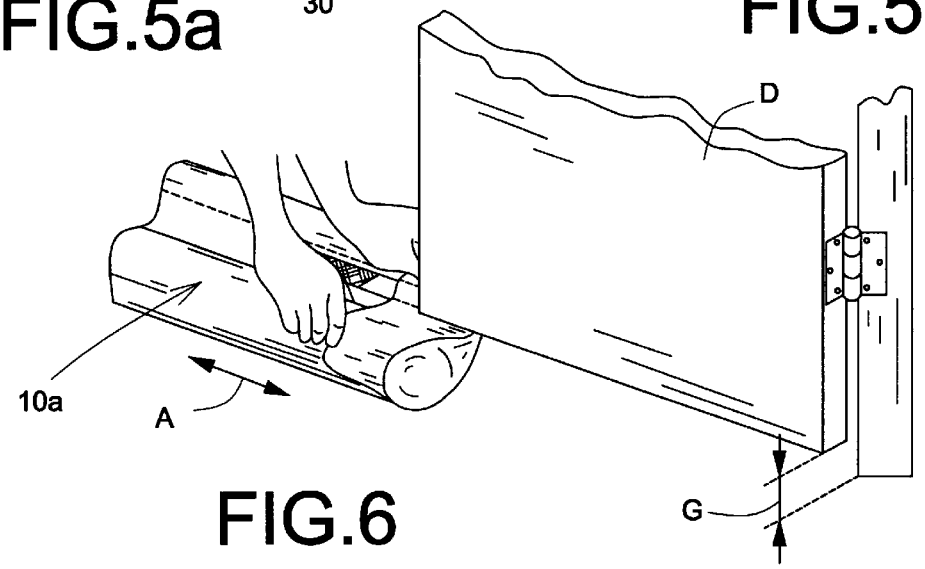
FIG. 6 is a view similar to FIG. 2, showing the embodiment of FIG. 4 being inserted with the folded end first under the bottom surface of a door.

Referring to FIGS. 2 and 6, the device 10, 10*a* is slidably inserted ithrough the gap G between the bottom surface E of the door D and the underlying floor F, as shown by arrow A. The device 10*a* preferably slides under the door D with the folded end 29 first and up against the bottom surface E of the door D, as illustrated in FIG. 6. Obviously, the device 10, 10*a* follows the door D during its pivoting motion by sliding over the floor F, along arrow B.

Although the present removable draft excluder device has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A removable draft excluder for excluding drafts by sealing a gap between a bottom surface of a door and an underlying floor surface, said draft excluder comprising:

a first and a second sleeve, each having a generally elongated configuration for respectively receiving a first and a second blocking member;

a base section extending between said first and second sleeves and maintaining the latter in a generally parallel and spaced apart relationship relative to each other;

said first sleeve defining a sleeve first longitudinal end, a longitudinally opposed sleeve second longitudinal end and a sleeve length therebetween, said sleeve first end being closed and said sleeve second end being open; said first blocking member defining a blocking member first longitudinal end, a blocking member second longitudinal end and a blocking member length therebetween; said blocking member length being smaller than said sleeve length so that when said first blocking member is inserted into said first sleeve with said blocking member first end positioned adjacent said sleeve first end said first sleeve defines a sleeve foldable segment extending between a fold line positioned generally in register with said blocking member second end and said sleeve second end, said foldable segment being foldable about said fold line towards said sleeve first end into a folded configuration such that a portion of said foldable segment lies over a portion of said first sleeve beyond said fold line, a length of said foldable segment being generally proportional to a difference between said sleeve length and said blocking member length;

wherein when said first sleeve is in an unfolded configuration with said sleeve foldable segment extending generally collinearly from the remainder of said first sleeve, said first sleeve foldable segment allows longitudinal insertion and withdrawal of said first blocking member into and from said first sleeve; and wherein when said foldable segment is in said folded configuration an abutting section of said foldable segment positioned adjacent said fold line abuttingly contacts said blocking member second end for preventing axial movement of said first blocking member relative to said first sleeve; and fastening means for releasably maintaining said foldable segment in said folded configuration.

2. The draft excluder defined in claim 1 wherein said fastening means is a hook and loop fastener.

3. The draft excluder defined in claim 1 wherein each of said blocking members has a length substantially equal to a length of said door bottom surface.

4. The draft excluder defined in claim 1 wherein said base section extends integrally from both said first and second sleeves.

5. The draft excluder defined in claim 4 wherein said fastening means is secured to said base section adjacent said sleeve second end.

6. The draft excluder defined in claim 1 wherein said first and second sleeves are made out of a fabric material.

7. The draft excluder defined in claim 6 wherein said fabric material is water impermeable material.

8. The draft excluder defined in claim 1 wherein said base section is stretchable in a direction transverse to a longitudinal axis of said first and second sleeves so as to enable both of said first and second sleeves, with corresponding said first and second blocking members inserted therein, to be adapted to simultaneously contact corresponding longitudinal edges of said bottom surface.

9. The draft excluder defined in claim 1 wherein said first and second sleeves are spaced away from each other by a distance substantially equal to a width of said bottom surface.

10. A removable draft excluder for excluding drafts by sealing a gap between a bottom surface of a door and an underlying floor surface, said draft excluder comprising:

a first and a second sleeve, each having a generally elongated configuration for respectively receiving a first and a second blocking member;

a base section extending between said first and second sleeves and maintaining the latter in a generally parallel and spaced apart relationship relative to each other;

each one of said sleeves defining a sleeve first longitudinal end, a longitudinally opposed sleeve second longitudinal end and a sleeve length therebetween, each of said sleeve first ends being closed and each of said sleeve second ends being open; each one of said blocking members defining a blocking member first end, a blocking member second end and a blocking member length therebetween; each of said blocking member lengths being smaller than each of said sleeve lengths so that when said blocking members are inserted into said sleeves with said blocking member first ends positioned adjacent said sleeve first ends said sleeves define a sleeve foldable segment extending between a fold line positioned generally in register with said blocking member second ends and said sleeve second ends, said foldable segment being foldable about said fold line towards said sleeve first ends into a folded configuration such that a portion of said foldable segment lies over a portion of said sleeves beyond said fold line a length of said foldable segment being generally proportional to a difference between said sleeve lengths and said blocking member lengths;

wherein when said foldable segment is in an unfolded configuration extending generally collinearly from the remainder of said sleeves, said sleeve foldable segment allows longitudinal insertion and withdrawal of said blocking members into and from said sleeves; and wherein when said foldable segment is in said folded configuration an abutting section of said foldable segment positioned adjacent said fold line abuttingly contacts said blocking member second ends for preventing axial movement of said blocking members relative to said sleeves; and fastening means for releasably maintaining said foldable segment in said folded configuration.

11. The draft excluder defined in claim 10 wherein said fastening means is a hook and loop fastener.

12. The draft excluder defined in claim 10 wherein said base section extends integrally from both said first and second sleeves.

13. The draft excluder defined in claim 12 wherein said fastening means is secured to said base section adjacent said sleeve second ends.

14. The draft excluder defined in claim 12 wherein said first and second sleeves are spaced away from each other by a distance substantially equal to a width of said bottom surface.

15. A removable draft excluder for excluding drafts by sealing a gap between a bottom surface of a door and an underlying floor surface, said draft excluder comprising:

a first and a second sleeve, each having a generally elongated configuration for respectively receiving a first and a second blocking member;

a base section extending between said first and second sleeves and maintaining the latter in a generally parallel and spaced apart relationship relative to each other;

at least one of said sleeves defining a sleeve first longitudinal end, a longitudinally opposed sleeve second longitudinal end and a sleeve length therebetween, said sleeve first end being closed and said sleeve second end being open; at least one of said respective blocking members defining a blocking member first end, a blocking member second end and a blocking member length therebetween; said blocking member length being smaller than said sleeve length, said one sleeve being foldable about a sleeve fold line between a sleeve folded configuration and a sleeve unfolded configuration, said sleeve fold line positioned generally in register with said blocking member second end and dividing said one sleeve into a sleeve receiving section for receiving said one blocking member with said blocking member first end positioned adjacent said sleeve first end and a sleeve retaining section extending between said fold line and said sleeve second end for retaining said one blocking member within said sleeve receiving section;

wherein when said one sleeve is in said sleeve unfolded configuration, said sleeve retaining section is in a generally collinear relationship relative to said sleeve receiving section so that said sleeve receiving and retaining sections together defining a generally continuous channel allowing longitudinal slidable insertion of said one blocking member into said sleeve receiving section; and wherein when said one sleeve is in said sleeve folded configuration, a portion of said sleeve retaining section is folded over at least a portion of said sleeve receiving section so that said one sleeve adjacent said fold line prevents withdrawal of said one blocking member from said sleeve receiving section; and fastening means for releasably maintaining said sleeve retaining section folded over in said sleeve folded configuration.

16. The draft excluder defined in said claim 15 wherein fastening means is a hook and loop fastener.

17. The draft excluder defined in claim 15 wherein said base section extends integrally from both said first and second sleeves.

18. The draft excluder defined in claim 17 wherein said fastening means is secured to said base section adjacent said sleeve second end.

19. The draft excluder defined in claim 15 wherein said first and second sleeves are made out of a fabric material.

20. The draft excluder defined in claim 15 wherein said base section is stretchable in a direction transverse to a longitudinal axis of one of said first and second sleeves so as to enable both of said first and second sleeves, with said first and second blocking members inserted therein, to be adapted to be simultaneously in contact with corresponding longitudinal edges of said bottom surface.

* * * * *